US012168808B2

(12) United States Patent
Li et al.

(10) Patent No.: US 12,168,808 B2
(45) Date of Patent: Dec. 17, 2024

(54) DEGASSING METHOD FOR MANUFACTURING ULTRA-LOW CARBON, NITROGEN, SULFUR STEEL

(71) Applicant: United States Steel Corporation, Pittsburgh, PA (US)

(72) Inventors: Yun Li, Murrysville, PA (US); David L. Runner, Louisville, KY (US); Jonathan D. Youngblood, Southaven, MS (US); Scott R. Story, Pittsburgh, PA (US)

(73) Assignee: United States Steel Corporation, Pittsburgh, PA (US)

( * ) Notice: Subject to any disclaimer, the term of this patent is extended or adjusted under 35 U.S.C. 154(b) by 0 days.

(21) Appl. No.: 17/897,824

(22) Filed: Aug. 29, 2022

(65) Prior Publication Data

US 2023/0093078 A1 Mar. 23, 2023

Related U.S. Application Data

(60) Provisional application No. 63/237,636, filed on Aug. 27, 2021.

(51) Int. Cl.

| | |
|---|---|
| ***C21C 7/068*** | (2006.01) |
| ***C21C 5/52*** | (2006.01) |
| ***C21C 7/00*** | (2006.01) |
| ***C21C 7/06*** | (2006.01) |
| ***C21C 7/064*** | (2006.01) |
| ***C22C 38/00*** | (2006.01) |

(52) U.S. Cl.

CPC ..... *C21C 7/068* (2013.01); *C21C 5/52* (2013.01); *C21C 7/0075* (2013.01); *C21C 7/06* (2013.01); *C21C 7/064* (2013.01); *C22C 38/004* (2013.01)

(58) Field of Classification Search

CPC ..... C21C 7/068; C21C 5/52; C21C 7/0075; C21C 7/06; C21C 7/064; C21C 2007/0093; C21C 7/0087; C21C 7/072; C21C 7/10; C22C 38/004

USPC ..... 420/129

See application file for complete search history.

(56) References Cited

U.S. PATENT DOCUMENTS

| | | | |
|---|---|---|---|
| 6,355,205 | B1 | 3/2002 | Orito et al. |
| 2010/0024596 | A1 | 2/2010 | Geldenhuis et al. |
| 2010/0276102 | A1 | 11/2010 | McQuillis et al. |
| 2019/0062854 | A1 | 2/2019 | Sosinsky et al. |
| 2023/0323492 | A1 | 10/2023 | Li et al. |

FOREIGN PATENT DOCUMENTS

| | | | |
|---|---|---|---|
| EP | 3147376 | A1 | 3/2017 |
| JP | 07150220 | A | 6/1995 |
| JP | 2001271147 | A | 10/2001 |
| JP | 2004156083 | A | 6/2004 |
| JP | 2005336503 | A | 12/2005 |
| JP | 2010116611 | A | 5/2010 |
| KR | 101119022 | B1 | 3/2012 |
| WO | 2011156858 | A1 | 12/2011 |

OTHER PUBLICATIONS

Satyendra, "Ladle Metallurgy", ISPAT Guru, Apr. 23, 2014 (Year: 2014).*

Britannica, "Secondary Steelmaking", Jul. 19, 2019 (Year: 2019).*

Van Ende et al. "A Kinetic Model for the Ruhrstal Heraeus (RH) Degassing Process", Metallurgical and Materials Transactions, vol. 42B, Jun. 2011 (Year: 2011).*

Total Materia, "Ultra Low Carbon Interstitial Free Steels", Aug. 2015 (Year: 2015).*

Oda et al., "Ultra-low Sulfur Non-oriented Electrical Steel Sheets for Highly Efficient Motors: NKB-Core", NKK Technical Review, No. 87, Jan. 1, 2002, pp. 12-18.

International Search Report and Written Opinion received for PCT Application Serial No. PCT/US2022/075611 dated Mar. 2, 2023, 12 pages.

Takahashi et al., "Mechanism of Decarburization in RH Degasser", ISIJ International (Japan) vol. 35, Iss. 12, (1995): 1452-1458.

Nakayama et al., "Effects of aluminum and nitrogen on the magnetic properties of non-oriented semi-processed electrical steel sheet", Journal of Magnetism and Magnetic Materials 213 (2000): 87-94.

Nakayama et al., "Effects of manganese and sulfur contents and slab reheating temperature on the magnetic properties of non-oriented, semi-processed electrical steel sheet", Journal of Magnetism and Magnetic Materials 223, (2001): 55-61.

Oda et al., "The effects of sulfur on magnetic properties of non-oriented electrical steel sheets"; Journal of Magnetism and Magnetic Materials, 254-255, (2003): 361-363.

Ou et al., "Desulfurization by Powder Top Injection Process in RH Degasser", AISTech 2005, vols. I & II and ICS 2005 Conference Proceedings; vol. I, vol. I & II, (May 9, 2005).

Hou, "Effects of sulfur content and slab reheating temperature on the magnetic properties of fully processed nonoriented electrical steels", Journal of Magnetism and Magnetic Materials 320 (2008): 1115-1122.

(Continued)

*Primary Examiner* — Brian D Walck
*Assistant Examiner* — Danielle M. Carda
(74) *Attorney, Agent, or Firm* — Alan G. Towner; Leech Tishman Fuscaldo & Lampl

(57) ABSTRACT

The present disclosure provides a method of making low carbon steel. The method includes tapping the liquid steel out of a primary steelmaking furnace. Deoxidizing the liquid steel. Transferring the deoxidized liquid steel to a ladle metallurgy furnace. Removing sulfur at the ladle metallurgy furnace. Adding fluxes and arcing the liquid steel to prevent sulfur reversion. Transferring the liquid steel from the ladle metallurgy furnace to an RH degasser for carbon removal. The removal of oxygen and sulfur prior to transferring the liquid steel to the RH degasser facilitates nitrogen removal and prevents carbon pick up during the step sulfur removal.

7 Claims, 6 Drawing Sheets

(56) References Cited

OTHER PUBLICATIONS

Li et al., "Impacts of Modification of Alloying Method on Inclusion Evolution in RH Refining of Silicon Steel", MDPI Materials, 10, 1206, Year: 2017, 8 pages.

* cited by examiner

DEGASSING METHOD FOR MANUFACTURING ULTRA-LOW CARBON, NITROGEN, SULFUR STEEL

CROSS-REFERENCE TO RELATED APPLICATION

This application claims the benefit of U.S. Provisional Patent Application No. 63/237,636 filed Aug. 27, 2021, which is incorporated herein by reference.

BACKGROUND INFORMATION

Typically, vacuum degassers utilized in the steel industry are either a Ruhrstale and Heraeus (RH) degasser or a Vacuum Tank Degasser (VTD). The RH degasser may be used for carbon removal and the tank degasser may be used for nitrogen and sulfur removal. The liquid steel tapped out of an Electric Arc Furnace (EAF) may contain higher contents of nitrogen and sulfur compared to that of a Basic Oxygen Furnace (BOF). As such, plants utilizing an EAF may choose to install a tank degasser, and BOF plants may choose to install an RH degasser.

The vacuum processes conducted outside a primary steelmaking furnace may be utilized to further remove carbon and decrease the solubility of hydrogen and nitrogen by lowering the partial pressures of CO, $H_2$, and $N_2$. Because of its high carbon removal efficiency, an RH degasser may be installed in shops intended for mass production of ultra-low carbon steel products. However, conventional RH degasser process has essentially no capability to remove sulfur and has very limited capability to remove nitrogen. Even if auxiliary equipment such as those to enable powder injection is installed at the RH degasser, the sulfur removal capability is very limited. To produce steel that requires ultra-low carbon, nitrogen, and sulfur using the RH degasser, in a EAF shop where the sulfur and nitrogen tapping out from the EAF furnace are high, or in a BOF shop where the sulfur tapping out from the BOF furnace is low but further sulfur removal is required to achieve the ultra-low sulfur levels, remains a big challenge and that is the subject of this invention.

SUMMARY

A method of making low carbon steel. The method includes tapping the liquid steel out of a primary steelmaking furnace. Deoxidizing the liquid steel. Transferring the deoxidized liquid steel to a ladle metallurgy furnace. Removing sulfur at the ladle metallurgy furnace. Adding fluxes and arcing the liquid steel to prevent sulfur reversion. Transferring the liquid steel from the ladle metallurgy furnace to an RH degasser for carbon removal. The removal of oxygen and sulfur prior to transferring the liquid steel to the RH degasser facilitates nitrogen removal and prevents carbon pick up during the step of adding fluxes and arcing for sulfur removal when sulfur removal is carried out after the RH treatment.

A steel sheet product having as low as 0.003 wt. % weight percent carbon, 0.003 weight percent nitrogen and 0.003 weight percent sulfur. The steel product has been subjected to deoxidation and sulfur removal at a ladle metallurgy furnace prior to decarbonization at an RH degasser thereby preventing carbon pickup from flux materials added for sulfur removal A method of making low carbon steel product having as low as 0.003 wt. % weight percent carbon, 0.003 weight percent nitrogen and 0.003 weight percent sulfur. The method include the steps of tapping the liquid steel out of a primary steelmaking furnace. Transferring the liquid steel to a ladle metallurgy furnace. Removing sulfur from the liquid steel in the ladle metallurgy furnace. Deoxidizing the liquid steel and skimming off slag to prevent sulfur reversion at the ladle metallurgy furnace. T and transferring the liquid steel from the ladle metallurgy furnace to an RH degasser for carbon removal, wherein the removal of oxygen and sulfur prior to transferring the liquid steel to the RH degasser facilitates nitrogen removal and prevents carbon pick up during the step of skimming and arcing for sulfur removal the RH treatment.

DETAILED DESCRIPTION

Figure 1:
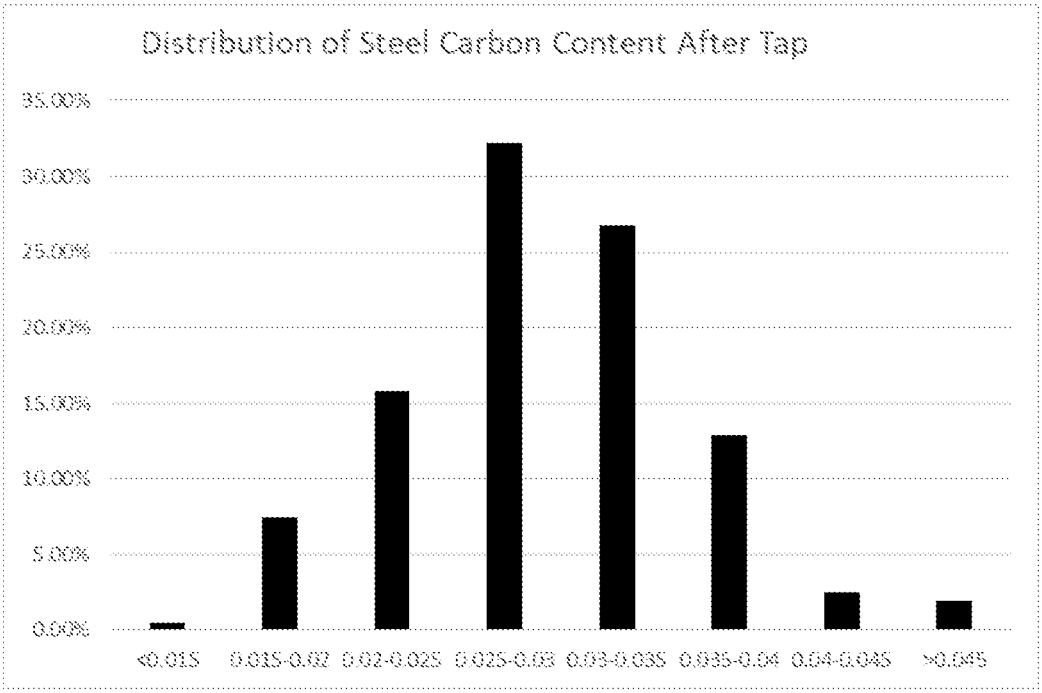
FIG. 1 provides a graph of the distribution of carbon content in IF (Interstitial Free) steel heats tapped out of the EAF furnace.

The process of producing steel may include the steps: EAF (or BOF)→LMF→RH→CC:

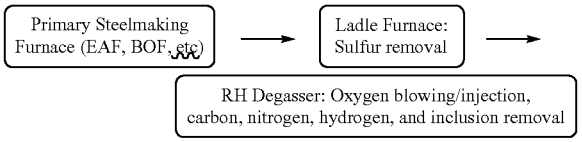

After the liquid steel, i.e., the heat is tapped out of the primary steelmaking furnace, for example, an electric arc furnace or a basic oxygen furnace. The heat may be deoxidized either during tapping or at the LMF. Then the heat may be treated at the LMF for sulfur removal, to a desired low sulfur level required by the product, for example to an ultra-low (<=0.003 wt. %) level. Measures may be taken to prevent/minimize sulfur reversion during the downstream processes at the RH degasser. Those measures may include: (a) adding fluxes, such as lime, to increase the solid portion of the slag; (b) adding a reducing agent such as briquettes containing aluminum and/or calcium carbide; and/or (c) skimming off a portion or all the sulfur containing ladle slag and adding fluxes to make appropriate slag cover again. The heat may then be sent to the RH degasser to remove carbon and/or nitrogen and/or hydrogen.

The ultra-low sulfur in the liquid steel and the low oxygen content of the steel (killed steel) arriving at the RH degasser may enable rapid nitrogen removal at the RH degasser under vacuum. It may also enable fast pump down, e.g., as fast as the vacuum system can do, without steel splashing which often occurs in the RH vessel in the conventional RH treatment with open (unkilled) heat. When carbon removal is desired, oxygen may be blown through the top lance or side tuyeres into the heat. Once the aluminum in the steel is removed by oxygen, decarburization may follow. The oxygen blow/injection may be controlled such that the dissolved oxygen level in the liquid steel is high enough that the decarburization reaction will not be hindered, but low enough to not to promote sulfur reversion from the slag. That level may be around 200 ppm dissolved oxygen in the liquid steel. Following decarburization, the heat may be killed and alloys containing titanium, niobium, manganese, silicon, aluminum, chromium, etc., may be added into the RH degasser vessel to achieve desired steel grade chemistry specifications. Sufficient recirculation time in the RH before and after the alloy addition may allow inclusion floatation to produce clean steel. Depending on the type of caster, further treatment such as calcium treatment for thin slab caster may be desirable before sending the heat to the caster.

Deoxidizing the liquid steel may be accomplished before or after transferring the steel to a ladle metallurgy furnace to remove sulfur. In various embodiments of the present invention the heat does not have to be oxidized (not killed) for vacuum decarburization: it may be killed (for sulfur removal) and then blown "open" (using, for example, top blown oxygen) for vacuum decarburization. Embodiments of the present invention may make it possible to produce steel with ultra-low carbon (as low as less than 30 ppm), ultra-low nitrogen (for example as low as less than 30 ppm), and ultra-low sulfur (for example as low as less than 30 ppm), consistently and rapidly through an RH degasser, even from liquid steel tapped out of the primary steelmaking furnace with high levels of sulfur and nitrogen such as those from an EAF furnace.

In various embodiments of the present invention, a process to remove sulfur from steel before carbon removal in the degasser may be used to prevent carbon pickup from flux materials added for sulfur removal and from electrode during arcing in the process that removes sulfur after carbon removal at the RH degasser.

In various embodiments of the present invention the LMF may be used to remove sulfur prior to vacuum decarburization. This process may result in: (1) a larger amount of sulfur (e.g., a few hundreds of ppm) may be removed; and (2) distribution of the two functions (sulfur removal and carbon removal) at two facilities that can operate in parallel or concurrently (LMF and RH) and hence increased shop productivity.

Embodiments of the present invention utilize techniques to prevent/minimize sulfur reversion from the slag to the steel during subsequent decarburization. Embodiments of the present invention utilize the ultra-low sulfur level achieved at the LMF to accelerate nitrogen removal at the degasser. Therefore, a significant amount of nitrogen may be removed at the RH degasser to produce ultra-low nitrogen steel even from liquid steel with higher nitrogen levels such as those tapped out of an EAF furnace. Embodiments of the present invention may shorten the tap to cast time and hence reduce energy consumption (less electrical arcing at the LMF) and reduce the ladle refractory consumption.

An RH degasser may be installed in a BOF shop in which the liquid steel tapped from the BOF contains a lower sulfur level (e.g., less than 0.01 wt. % and as low as less than 0.003 wt. % and to over 0.02 wt. % and as high as over 0.03 wt. % from an EAF), and lower nitrogen level and hence sulfur and nitrogen removal may not be necessary; In prior processes, sulfur removal in RH may be possible by flux addition or injection when ultra-low sulfur is desired. The amount of sulfur removal may be limited and it may be difficult to use a starting sulfur level as high as those tapped from an EAF. The fluxes may contain a high percentage of calcium fluoride which may be detrimental to the refractory of the RH degasser: the lower vessel and snorkel only last for, for example, 2-3 heats.

Oxygen blowing/injection may be utilized with an RH degasser to accelerate decarburization or to increase steel temperature.

Table 1 shows the average and standard deviation of C, N ad S in IF heats made using a prior process. The average carbon, nitrogen, and sulfur in the liquid steel as measured from samples taken from the steel ladle after tapping from the EAF are 0.0296%, 0.0043%, and 0.0242%. High percentages of pig iron and HBI are used in the EAF to make the IF steel grades. As a result, the 0.0043% average nitrogen is lower than that in other steel grades in which nitrogen is not critical. Higher percentages of those "virgin" materials normally means higher cost. FIG. 1 shows the carbon content is lower than other grades as practices are in place at the EAF to tap out steel with lower carbon and higher oxygen contents to facilitate carbon removal at the RH degasser. This may also lead to lower iron yield as more iron will be oxidized in the EAF furnace.

TABLE 1

Average and standard deviation of C, N, and S in IF heats made using previous process (EAF-LMF-RH-LMF-CC)

| | Avg C, % | Std C, % | Avg N, % | Std N, % | Avg S, % | Std S, % |
|---|---|---|---|---|---|---|
| After EAF Tap | 0.0296 | 0.0068 | 0.0043 | 0.0012 | 0.0242 | 0.0042 |
| After RH | 0.0011 | 0.0007 | 0.0048 | 0.0013 | 0.0241 | 0.0043 |
| After LMF | 0.0037 | 0.0011 | 0.0058 | 0.0015 | 0.0029 | 0.0014 |
| Caster Final | 0.0052 | 0.0022 | 0.0062 | 0.0017 | 0.0027 | 0.0010 |

Figure 2:
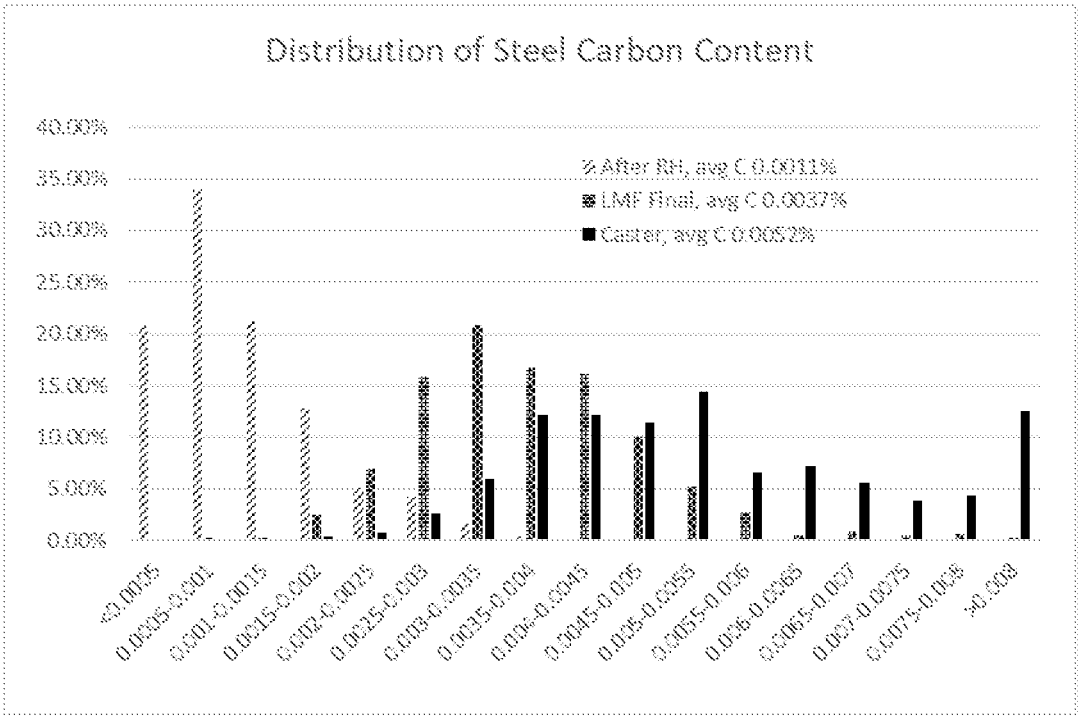
FIG. 2 provides a graph of the distribution of carbon content in IF steel heats after the RH treatment, LMF treatment, and at the caster using prior method.

For carbon, as the RH degasser is very efficient for carbon removal, the average carbon content in liquid steel after the RH degasser treatment, as measured in the first sample taken at the LMF after the heat returned to the LMF, is 0.011% with a standard deviation of 0.0007%. As shown in FIG. 2, in 90% of the heats the carbon was lowered to below 0.002%. However, in the LMF process after the heat was returned to the LMF, significant amount of carbon pickup occurred as demonstrated in Table 1 and FIG. 2. Potential sources of carbon pickup include flux additions, ladle refractory, and electrode (during arcing). It may be pointed out that measures, such as heating the heat to fairly high temperature to minimize the arcing after the heat is back to the LMF for the second time, and not to use calcium carbide for sulfur removal, have been in place in the attempt to minimize the carbon pickup. As also shown in Table 1 and FIG. 3, there is an additional 0.0015%, on average, of carbon pickup from the LMF to the caster which certainly need to be improved.

Figure 3:
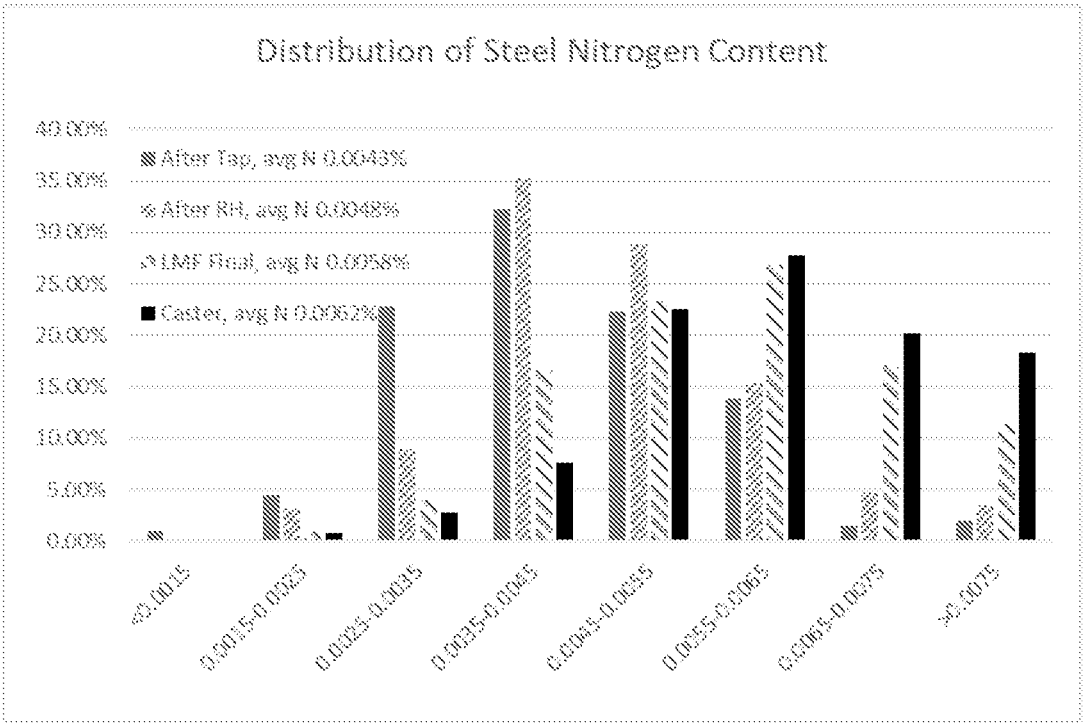
FIG. 3 provides a graph of the distribution of nitrogen content in IF steel heats in different stages of steelmaking processes using prior method.

For nitrogen, as shown in Table 1 and FIG. 3, its content steadily increased throughout the process. There is no nitrogen removal but a slight pickup from the RH treatment. This is expected as the sulfur in the steel is so high it would prevent nitrogen removal under vacuum at the RH degasser. Before taking the sample at the LMF after the RH, strong stirring had to be employed to break the slag crust so there may be a slight nitrogen pickup from that.

Figure 4:
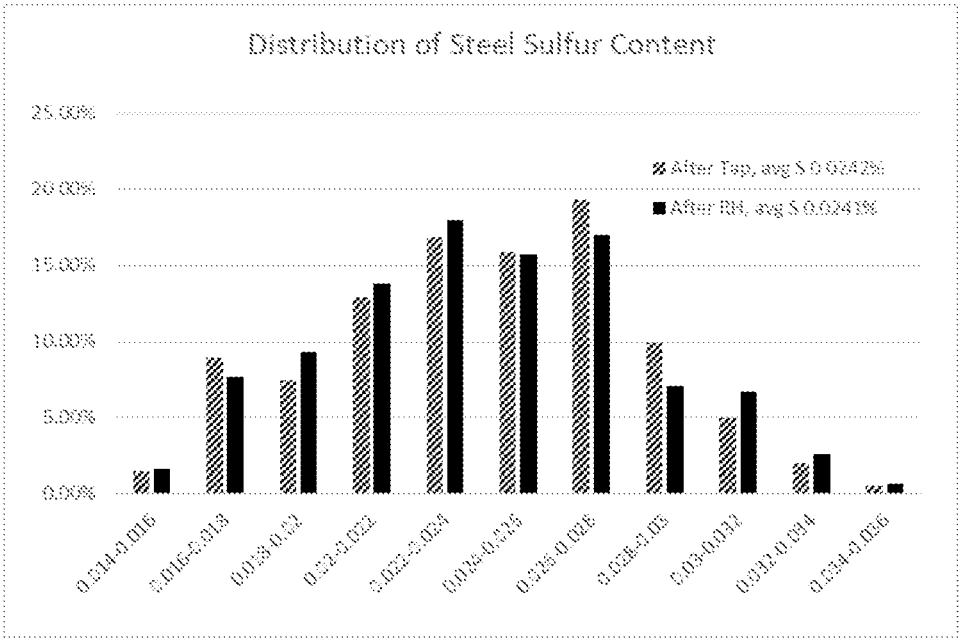
FIG. 4 provides a graph of the distribution of sulfur contents in IF steel heats before sulfur removal in a EAF shop.
Figure 5:
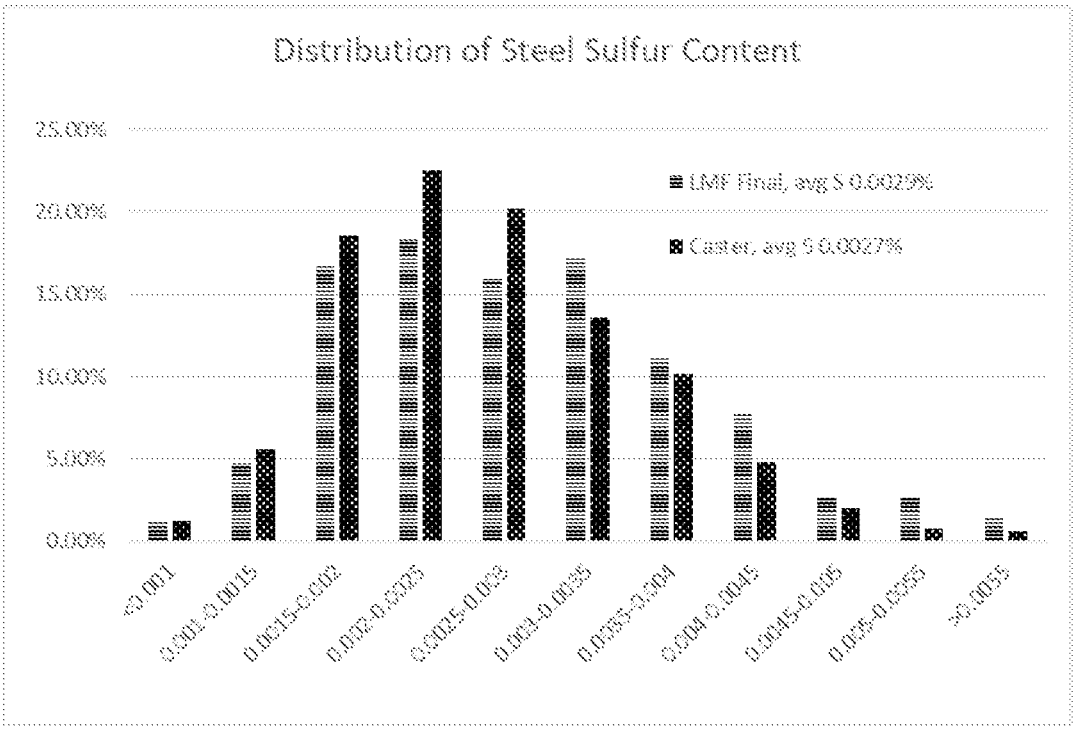
FIG. 5 provides a graph of the distribution of sulfur content in IF steel heats after sulfur removal at the LMF.

For sulfur, there is no removal during the first round of the LMF treatment and the RH treatment as demonstrated in Table 1 and FIG. 4. When the heat returned to the LMF, flux additions and strong stirring were applied to remove sulfur. The sulfur was lowered to 0.0029% on average. The sulfur level remains steady, with a very slight drop, from the LMF to the caster as shown in FIG. 5 and Table 1.

The following examples are intended to illustrate various aspects of the present invention, and are not intended to limit the scope of the invention.

Example 1—Heat 42105706

The general process after the heat was tapped out of the EAF furnace follows the six steps described above.

In this particular heat, the final EAF furnace measurement showed 3033° F. and 690 ppm oxygen for the liquid steel in the EAF furnace. The 163 short ton heat was tapped out of the EAF, without any addition during tapping, at 11:17 AM on May 5, 2021. The heat was then sent to the LMF. Argon stirring from both two porous plugs in the steel ladle were initiated when the heat approaches the LMF on the transfer car on the V-track from the EAF to the LMF. Once the heat arrived at the LMF, the measurement at 11:19 AM showed the liquid steel is 2992° F. with 652 ppm oxygen. The heat was killed using 801 pounds of aluminum. With strong stirring from both argon plug, batches of fluxes were added to remove sulfur. Fluxes additions include 3284, 502, 105, 39 pounds of lime, calcium aluminate, slag deoxidizer, and calcium carbide, respectively. After the sulfur removal process and the sample showed 0.0027% sulfur, as shown in Table 2, the heat was arced for 10 minutes to bring the temperature to 2974° F. Then the heat was arced for 4 more minutes to compensate the temperature loss from the final flux additions. The final flux additions include 1004 pounds of lime and 102 pounds of slag deoxidizer. The lime was added to thicken the slag and the slag deoxidizer was added to be trapped in the slag and react with oxygen diffused into the slag layer later at the RH when oxygen is blow into the heat. Both measures were taken to minimize sulfur reversion during the later treatment at the RH degasser. The LMF treatment finished at 12:04 PM.

The heat was then shipped to the RH degasser via crane. The vacuum treatment started at 12:14:20 PM. At the RH, the vacuum was pumped down as fast as the system can as there is no splashing of metal inside the vessel that caused by the initial violent carbon-oxygen reaction in un-killed heat in previous process. Higher lifting gas flow was also used from the start, rather than ramp up later in previous process. In embodiments of the present invention, 10 to 15 minutes of deep vacuum may be used as the first stage of the vacuum treatment to remove nitrogen. In this particular heat, a shortened total RH process time was necessary to keep the shop pace, only 8.5 minutes elapsed from start of the vacuum to the start of oxygen blow. Near the end of that period, a steel sample was taken and analyzed. The carbon, aluminum, and silicon contents from the analysis were fed into a model to calculate the oxygen required for decarburization. The goal was set to control the oxygen content at the end of decarburization cycle to around 200 ppm. In some embodiments, the oxygen was also blown in one or two or three batches in order to lower the peak oxygen content in the steel to minimize sulfur reversion. In this particular heat, 168 Nm3 of oxygen was blown into the heat via the top lance in one batch. The oxygen was blown in one batch to shorten the process time. Two minutes after the blow end, measurements showed an oxygen content of 316 ppm oxygen. Near the end of decarburization, the measurement showed 2941° F. with 211 ppm oxygen. The heat was killed at 12:45:04 PM. After titanium addition, the vacuum was broken, and the heat was sent out to the trim station at the RH facility for calcium treatment. Calcium treatment may be used for the heat to be cast at a thin slab caster. At the time of this trial, the slag breaker at the trim station is located at the opposite side of the ladle in relation to the location of the calcium wire entrance point. Therefore, high flow of argon was used to break the crusty slag to facilitate the wire feeding. This caused a 4 ppm nitrogen pickup from sample L7 to L8 shown in Table 2.

TABLE 2

Carbon, nitrogen, and sulfur change in trial heat 2105706

| Sample Code | Sample Description | C, % | N, % | S, % |
|---|---|---|---|---|
| L1 | LMF Incoming | 0.027* | 0.0056 | 0.02* |
| L3 | LMF Final | 0.0239 | 0.0069 | 0.0027 |
| L7 | RH End Vacuum | 0.0012 | 0.0038 | 0.0052 |
| L8 | After Ca Treat at RH Trim Station | 0.0019 | 0.0042 | 0.0049 |
| CC | Caster | 0.0029 | 0.0044 | 0.0044 |
| SS | Steel Strip | 0.0035 | | 0.0032 |

The carbon, nitrogen and sulfur change throughout the process are listed in Table 2. For carbon, this trial heat ended 0.0029% at the caster, significantly lower than the 0.0052% average in the previous process. As shown in Table 1 and FIG. 2, there is a large variation in the carbon content among heats made in previous process and the frequency of heats finished over 0.0054% carbon at the caster was over 40%. With various embodiment of the current invention, without the carbon pickup during the heat back at the LMF after the RH degasser, such chance may be relatively very rare. For nitrogen, this particular heat finished in the low 40s ppm even though it started with higher than normal nitrogen in the steel tapping out of the EAF. The nitrogen removal cycle was cut short in this trial heat in order to simulate the situation when RH treatment time need to be cut short. And the strong stirring after the RH treatment may also have contributed to some nitrogen pickup. The sulfur reverted from 0.0027% to 0.0052% during the RH treatment. For sulfur restricted grades such as electrical steels, it is possible to keep the sulfur at ultra-low levels as the silicon and/or aluminum in those steel is generally high as demonstrated in examples 4 and 5.

Figure 6:
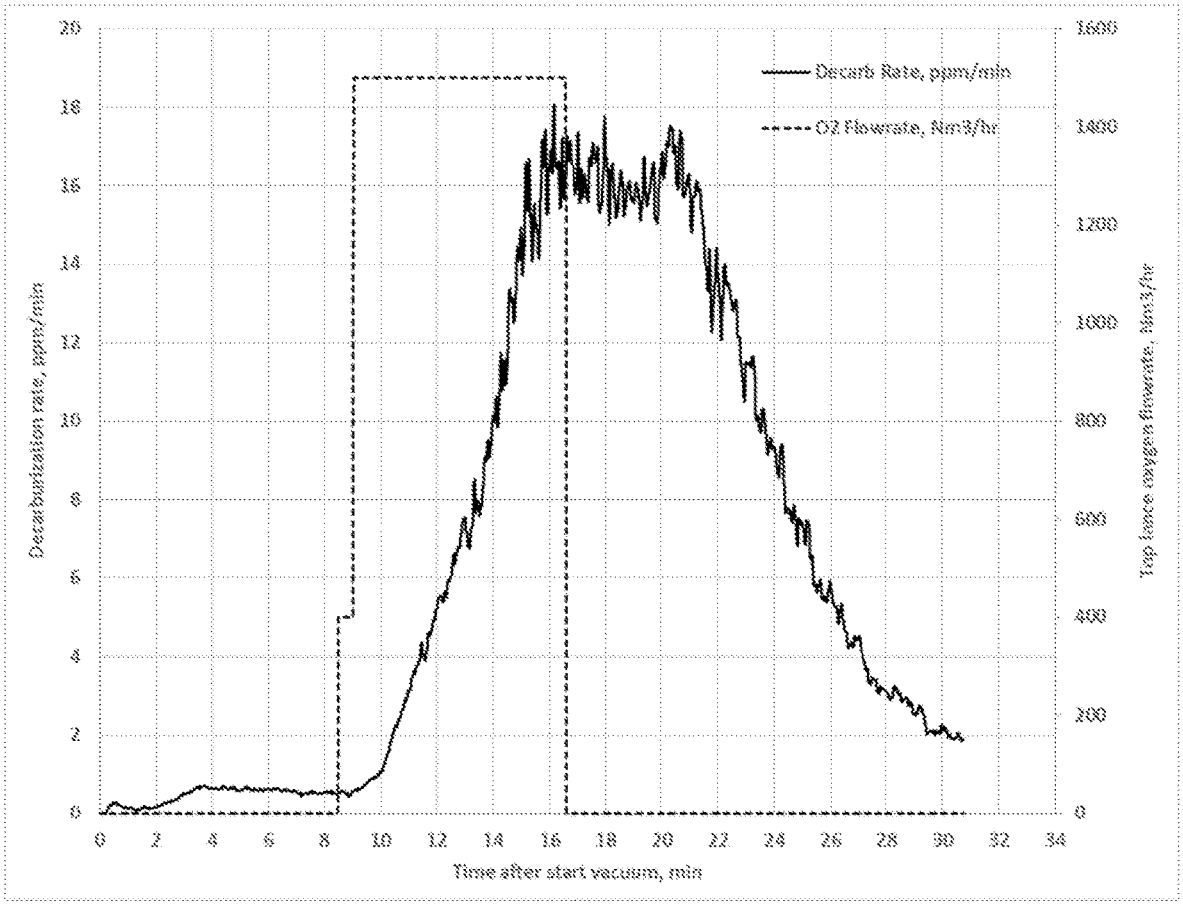
FIG. 6 provides a chart of time versus oxygen blow and decarburization rate during vacuum treatment in heat 2105706.

FIG. 6 shows the oxygen blow and decarburization rate during the vacuum treatment in the trial heat. As shown in the chart, 1-2 minutes after the start of oxygen blow, the decarburization rate started to pickup; it peaked around 17 ppm/min; and dropped to 2 ppm/min after 22 minutes. The heat was killed with aluminum then and the carbon in the sample taken after that was 0.0012%.

Example 2—Heat #2103796

This heat was a low carbon grade, not an ultra-low carbon grade heat. The heat was sent to the RH for a trial, to demonstrate the capability of the current process, and to bring it back to the LMF to add the carbon back to the aim 0.03% before sending to the caster. As the heat was killed and sulfur already removed, it was heated to 2989° F. and then 1017 pounds of lime and 103 pounds of slag deoxidizer were added to treat the ladle slag before sending to the RH degasser.

Figure 7:
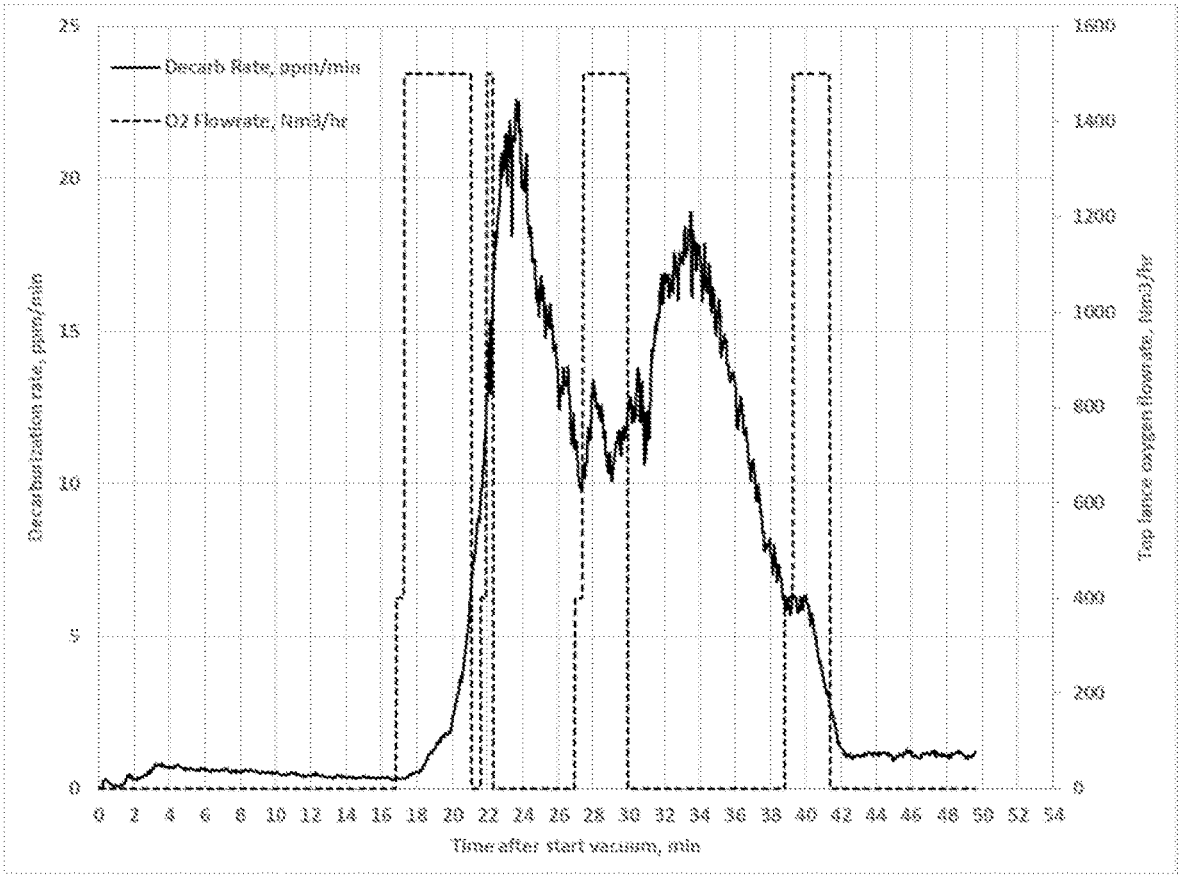
FIG. 7 provides a chart of time versus oxygen blow and decarburization rate during vacuum treatment in heat 2103796.

At the RH degasser, the heat was subjected to 15 minutes under deep vacuum for nitrogen removal and multiple samples were taken during that process to monitor the nitrogen removal process as the starting point of nitrogen in this heat was high: 110 ppm. The actual de-N cycle time, from start vacuum to start oxygen blow, was 16.8 minutes as shown in FIG. 7. As shown in Table 3, during the nitrogen removal cycle, the nitrogen content in steel decreased continuously, and the rate of nitrogen removal decreased as the nitrogen content decreased. For aluminum, there was around 0.012% loss in the de-N cycle before the start of oxygen blow. That is an indication of residual oxygen in the RH degasser system, possibly slag and oxidized residual steel inside the vessel and snorkel. A small amount of carbon removal, observed both from the decarburization rate (in FIG. 7) and the carbon content change, also point to residual oxygen in the RH system. The residual oxygen in the RH system may be lower as all the heats are killed before being delivered at the RH. And hence the aluminum loss may be lower and aiming the aluminum at 0.025% leaving the LMF may sufficient. Sulfur remained constant in the de-N cycle.

The decarburization process was long and four batches of oxygen were blown. The final carbon after the RH treatment was 0.0018%. Several samples were also taken, as shown in Table 3, and they showed the carbon change during the decarburization cycle. The nitrogen continued to drop, while at slower pace, during decarburization. Sulfur reversion was fairly limited. The oxygen blow was done in several batches and kept the oxygen content on the steel low during the decarburization process. After the trial at the RH, the heat was sent back to the LMF to re-carburize. This trial demonstrated that large amount of nitrogen can be removed using this invention, making the production of ultra-low carbon, nitrogen and sulfur steel possible.

TABLE 3

Carbon, nitrogen, and sulfur change in trial heat 2103796

| Sample Code | Sample Description | Al, % | C, % | N, % | S, % |
|---|---|---|---|---|---|
| L6 | LMF | 0.0260 | 0.0325 | 0.0110 | 0.0015 |
| L7 | LMF Final | 0.0347 | 0.0374 | 0.0110 | 0.0029 |
| L8 | RH De-N #1 | 0.0320 | 0.0324 | 0.0095 | 0.0024 |
| L9 | RH De-N #2 | 0.0284 | 0.0322 | 0.0080 | 0.0024 |
| L10 | RH De-N #3 | 0.0262 | 0.0317 | 0.0068 | 0.0024 |
| L11 | RH De-N #4 | 0.0238 | 0.0320 | 0.0062 | 0.0024 |
| L12 | RH De-N #5 | 0.0225 | 0.0317 | 0.0064 | 0.0025 |
| L13 | RH De-C #1 | 0.0032 | 0.0283 | 0.0056 | 0.0026 |
| L14 | RH De-C #2 | 0.0009 | 0.0207 | 0.0047 | 0.0027 |
| L15 | RH De-C #3 | 0.0003 | 0.0150 | 0.0045 | 0.0029 |
| L16 | RH De-C #4 | 0.0009 | 0.0028 | 0.0036 | 0.0033 |
| L17 | RH Final | 0.0624 | 0.0018 | 0.0042 | 0.0032 |

Example 3—Heat #2105095

Heat 2105095 was also a low carbon, not ultra-low carbon steel grade heat. The heat was killed and desulfurized at the LMF and then sent to the RH degasser for nitrogen and carbon removal. Those steps are in accordance with embodiments of the present disclosure. However, as the heat is not ultra-low carbon heat, after the RH treatment, instead of sending to the caster, the heat was sent back to the LMF for re-carburization and other treatment before sending to the caster.

The 164 short ton heat was tapped out of the EAF with a final measurement of 3016° F. and 799 ppm oxygen. The first LMF Celox® measurement showed 2994° F. and 746 ppm oxygen. The heat was killed with 766 pounds of aluminum. Fluxes including 3076 pounds of lime, 603 pounds of calcium aluminate, 188 pounds of slag deoxidizer, and 65 pounds of calcium carbide, were added into the ladle in multiple batches for sulfur removal. After sulfur removal, temperature measurements showed 2925° F. liquid steel temperature. The heat was then arced for 9 minutes before final slag treatment with 1008 pounds of lime and 104 pounds of slag deoxidizer. The final LMF temperature measurement after that showed 2964° F.

Figure 8:
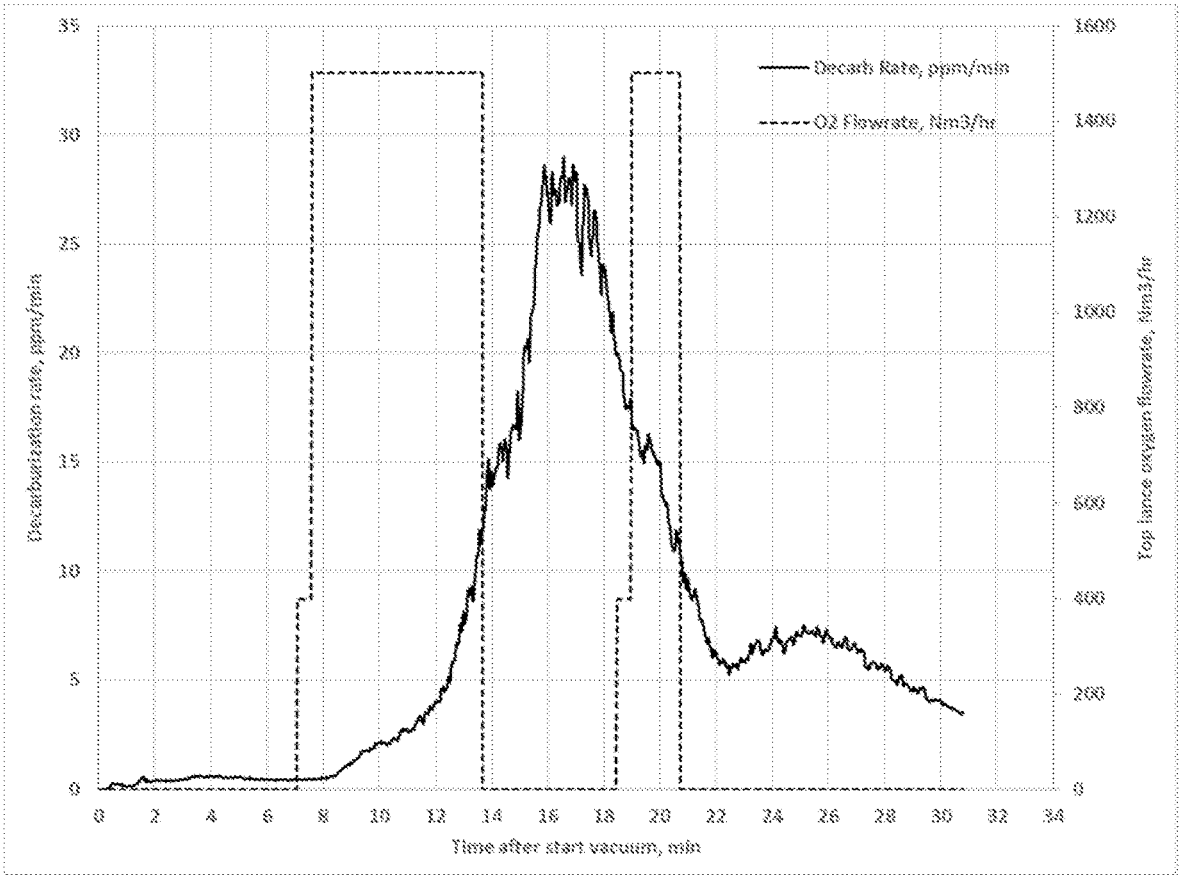
FIG. 8 provides a chart of time versus oxygen blow and decarburization rate during vacuum treatment in heat 2105095.

At the RH degasser, the initial de-N cycle was cut to 5 minutes to shorten the overall treatment time. The actual time from start vacuum to start oxygen blow was 7 minutes as shown in FIG. 8. The oxygen blow was divided into two batches: 155 and 47 Nm3. The pre-deoxidation measurement showed 175 ppm oxygen in the liquid steel. As shown in FIG. 8, the decarburization was hindered by the low oxygen content so the second batch of oxygen may be blown a little earlier with slightly larger amount. The oxygen blow model was further tunned after that heat. As shown in Table 4, the carbon was lowered down to a very low level. Despite the shorter de-nitrogenization cycle, due to the lower sulfur level in this heat, the nitrogen was also removed to very low level. And the sulfur reversion is also satisfactorily low in this heat.

TABLE 4

Carbon, nitrogen, and sulfur change in trial heat 2105095

| Sample Code | Sample Description | Al, % | C, % | N, % | S, % |
|---|---|---|---|---|---|
| L3 | LMF Final | 0.0420 | 0.0236 | 0.0057 | 0.0015 |
| L8 | RH | 0.0151 | 0.0013 | 0.0038 | 0.0028 |
| L9 | RH Final | 0.0166 | 0.0016 | 0.0033 | 0.0030 |

Example 4—Heat #2210182

This heat is a non-grain oriented (NGO) electrical steel grade with silicon, aluminum, and manganese being over 3%, 1%, and 0.5%, respectively. The heat was tapped out of the EAF, processed at the LMF and then at the RH degasser in similar fashion as described in previous examples except that large quantities of alloys for silicon, aluminum, and manganese were added at the RH degasser. The heat was sent to the thin slab caster after processing at the RH degasser. As shown in Table 5, ultra-low levels of carbon, nitrogen, sulfur, and titanium, which are critical for NGO steel, were achieved.

TABLE 5

Carbon, nitrogen, sulfur, and titanium change in trial heat 221082

| Sample Code | Sample Description | C, % | N, % | S, % | Ti, % |
|---|---|---|---|---|---|
| L4 | LMF Final | 0.0234 | 0.0072 | 0.0015 | 0.0003 |
| LF | RH Final | 0.0027 | 0.0021 | 0.0007 | 0.0015 |
| CCS | Caster Final | 0.0032* | 0.0012* | 0.0011* | 0.0020 |

*Results from combustion analysis using Leco

Example 5—Heat 42210184

This heat is again an NGO electrical steel grade following heat 2210182 described above in the casting sequence. As shown in Table 5, ultra-low levels of carbon, nitrogen, sulfur, and titanium, were achieved.

TABLE 6

Carbon, nitrogen, sulfur, and titanium change in trial heat 221082

| Sample Code | Sample Description | C, % | N, % | S, % | Ti, % |
|---|---|---|---|---|---|
| L7 | LMF Final | 0.0244 | 0.0083 | 0.0024 | 0.0004 |
| LF | RH Final | 0.0016 | 0.0026 | 0.0016 | 0.0015 |
| CCS | Caster Final | 0.0018* | 0.0021* | 0.0013* | 0.0017 |

*Results from combustion analysis using Leco

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it may be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

Whereas particular embodiments of this invention have been described above for purposes of illustration, it will be evident to those skilled in the art that numerous variations of the details of the present invention may be made without departing from the invention.

What is claimed is:

1. A method of making an ultra-low carbon steel product comprising:

tapping liquid steel out of a primary steelmaking furnace;

transferring the liquid steel to a ladle metallurgy furnace;

deoxidizing the liquid steel in the ladle metallurgy furnace producing killed deoxidized liquid steel and removing sulfur from the killed deoxidized liquid steel in the ladle metallurgy furnace to prevent carbon pick up;

adding a slag thickening material and a reducing agent containing aluminum into the killed deoxidized liquid steel prior to transferring the killed deoxidized liquid steel to a RH degasser to prevent sulfur reversion during decarburization at the RH degasser; and transferring the killed deoxidized liquid steel from the ladle metallurgy furnace to the RH degasser and oxidizing the killed deoxidated liquid steel in the RH degasser to remove carbon from the oxidized liquid steel to produce decarburized liquid steel comprising 0.003 wt. % or less carbon, wherein the removal of oxygen and sulfur prior to transferring the liquid steel to the RH degasser facilitates nitrogen removal and prevents carbon pick up during the step of removing sulfur.

2. The method of making the ultra-low carbon steel of claim 1, further comprising removing nitrogen while the liquid steel is in the RH degasser to reduce the amount of nitrogen in the liquid steel to 0.003 wt. % or less.

3. The method of making the ultra-low carbon steel of claim 1, further comprising removing aluminum and silicon by blowing oxygen through a top lance or tuyeres of the RH degasser.

4. The method of making low carbon steel of claim 3, wherein the amount of oxygen blown into the RH degasser is approximately 200 ppm to prevent sulfur reversion from slag.

5. The method of making the ultra-low carbon steel of claim 1, further comprising deoxidizing the liquid steel in the RH degasser after the step of removing carbon.

6. The method of making an ultra-low carbon steel of claim 1, wherein the steel comprises approximately 0.003 wt. % weight percent carbon, 0.003 weight percent nitrogen and 0.003 weight percent sulfur.

7. A method of making an ultra-low carbon steel product comprising:

tapping liquid steel out of a primary steelmaking furnace;

transferring the liquid steel to a ladle metallurgy furnace;

deoxidizing the liquid steel in the ladle metallurgy furnace producing killed deoxidized liquid steel and removing sulfur from the killed deoxidized liquid steel in the ladle metallurgy furnace to prevent carbon pick up;

skimming off slag from the killed deoxidized liquid steel prior to transferring the killed deoxidized liquid steel to a RH degasser to prevent sulfur reversion during decarburization at the RH degasser; and transferring the killed deoxidized liquid steel from the ladle metallurgy furnace to the RH degasser and oxidizing the killed deoxidated liquid steel in the RH degasser to remove carbon from the oxidized liquid steel to produce decarburized liquid steel comprising 0.003 wt. % or less carbon, wherein the removal of oxygen and sulfur prior to transferring the liquid steel to the RH degasser facilitates nitrogen removal and prevents carbon pick up during the step of removing sulfur.

* * * * *